US006242108B1

(12) United States Patent
Sordelet et al.

(10) Patent No.: US 6,242,108 B1
(45) Date of Patent: Jun. 5, 2001

(54) ABRASION RESISTANT COATING AND METHOD OF MAKING THE SAME

(75) Inventors: Daniel J. Sordelet, Ames; Matthew F. Besser, Urbandale, both of IA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/344,694

(22) Filed: Jun. 25, 1999

Related U.S. Application Data

(60) Provisional application No. 60/091,562, filed on Jul. 2, 1998.

(51) Int. Cl.[7] ..... B32B 15/00; C23C 4/04

(52) U.S. Cl. ..... 428/615; 427/446; 427/455; 428/671; 428/681; 428/686; 428/539.5; 428/908.8; 428/937

(58) Field of Search ..... 428/615, 671, 428/681, 686, 908.8, 937, 539.5; 427/446, 455; 75/230, 236, 238

(56) References Cited

U.S. PATENT DOCUMENTS 4,429,019 * 1/1984 Schrewelius ..... 428/937

* cited by examiner

*Primary Examiner*—Deborah Jones
*Assistant Examiner*—Robert R. Koehler
(74) *Attorney, Agent, or Firm*—Mark F. LaMarre; Thomas G. Anderson; Virginia B. Caress

(57) ABSTRACT

An abrasion resistant coating is created by adding a ductile phase to a brittle matrix phase during spray coating where an Al—Cu—Fe quasicrystalline phase (brittle matrix) and an FeAl intermetallic (ductile phase) are combined. This composite coating produces a coating mostly of quasicrystal phase and an inter-splat layer of the FeAl phase to help reduce porosity and cracking within the coating. Coatings are prepared by plasma spraying unblended and blended quasicrystal and intermetallic powders. The blended powders contain 1, 5, 10 and 20 volume percent of the intermetallic powders. The unblended powders are either 100 volume percent quasicrystalline or 100 volume percent intermetallic; these unblended powders were studied for comparison to the others. Sufficient ductile phase should be added to the brittle matrix to transform abrasive wear mode from brittle fracture to plastic deformation, while at the same time the hardness of the composite should not be reduced below that of the original brittle phase material.

20 Claims, No Drawings

ABRASION RESISTANT COATING AND METHOD OF MAKING THE SAME

This application claims priority from U.S. Provisional Application No. 60/091,562 filed on Jul. 2, 1998. This application was filed during the term of the beforementioned provisional application.

This invention is funded by the Department of Energy Under Contract W-7405-Eng-82. The government has certain rights to this invention.

BACKGROUND OF THE INVENTION

Quasicrystals are a relatively new class of materials which exhibit unusual atomic structure and useful physical and chemical properties. The term quasicrystal has been applied to structure that exhibit (1) long range quasiperiodic transnational order, by reference to ideal quasiperiodic mathematical functions, and (2) long range rotational order with disallowed crystallographic symmetry. For example, a rotational symmetry of five-fold yields pentagons in two-dimensional space, yet space cannot be completely filled by tiling pentagons. The inherent brittleness of quasicrystals has limited their potential use to surface coating applications.

Quasicrystals are materials which exhibit fascinating atomic structures and very unusual physical and transport properties. Their brittleness has limited the scope of potential applications primarily to surface coatings.

Properties of quasicrystals that are of interest for surface coatings include high hardness, low friction under certain conditions, reduced surface energy compared to crystalline metals and their oxides, extremely low thermal and electrical conductivities, and plasticity at elevated temperatures. While none of these properties when considered by themselves were remarkable or necessarily better than those of conventional surface coating materials, selected combinations of properties do offer unique benefits for a wide variety of applications. The low fracture toughness of quasicrystals is a serious limitation to using these materials in these applications.

Therefore, the principal object of this invention is to provide an abrasion resistant coating and method of making the same which will enable brittle quasicrystals to have enhanced abrasive wear behavior through the addition of a low level amount of ductile FeAl phase.

These and other objects will be apparent to those skilled in the art.

SUMMARY OF THE INVENTION

An abrasion resistant coating is created by adding a ductile phase to a brittle matrix phase during thermal spray coating where an Al—Cu—Fe quasicrystalline phase (brittle matrix) and a FeAl intermetallic (ductile phase) are combined. This composite coating produces a coating mostly of quasicrystal phase and an intersplat layer of the FeAl phase to help reduce porosity and cracking within the coating.

Coatings are prepared by plasma spraying unblended and blended quasicrystal and intermetallic powders. The blended powders contain 1, 5, 10 and 20 volume percent of the intermetallic powders. The unblended powders are either 100 percent by volume quasicrystalline or 100 percent by volume intermetallic.

The abrasion resistant coating contains a ductile phase of between 1–100 volume percent FeAl, and preferably between 5–50 volume percent FeAl. The abrasion resistant coating should contain at least between 1–20 volume percent FeAl.

Sufficient ductile phase should be added to the brittle matrix to transform abrasive wear mode from brittle fracture to plastic deformation, while at the same time the hardness of the composite should not be reduced below that of the original brittle phase material.

DESCRIPTION OF THE PREFERRED EMBODIMENT

The preferred quasicrystalline alloy (QC) of this invention has a nominal composition of $Al_{65}Cu_{23}Fe_{12}$. The ductile phase added to the quasicrystalline matrix is a commercial FeAl alloy from Ametek Specialty Metals having a nominal composition of $Fe_{68}Al_{30}Cr_2$ doped with 0.1 atomic percent B. This alloy, which will be referred to as FeAl, is easy to deposit by thermal spraying as a dense, crack-free coating. Morever, the FeAl coatings exhibit ductility.

A rubber wheel test involved loose particles, which indent the compliant rubber wheel rim during abrasion. The tendency of the particles to rotate away from cutting orientations is the result of the desire to minimize frictional energy dissipation. Tests utilized a load of 87.2 N with a total of 300 revolutions at a wheel speed of 200 rpm. Silica particles between 200 $\mu$m and 300 $\mu$m were used for the abrasive powder.

Generally, material removal rates during abrasive wear are higher when a brittle fracture wear mode is dominant compared to when wear occurs through plastic deformation. This is straight forward to visualize by considering that material removed by brittle fracture is swept away from the surface, while material that is worn during plastic flow may only be pushed ahead or to the side of the abrasive medium and is not necessarily removed from the sample surface.

The transition from a brittle fracture to a plastic flow mechanism that occurs through the addition of FeAl particles to the QC coating matrix explains the improved abrasive wear behavior of the composite coatings. In order to explain the anomalous improvement in abrasion resistance of the 1 volume percent FeAl coating, it is necessary to consider coating hardness together with the dominant wear mode. During abrasive wear, it is common for both brittle fracture and plastic flow wear mechanisms to occur. Treating each mechanism separately, however, helps illustrate the influence of hardness on abrasive wear. Conversely, if abrasive wear occurs only by brittle fracture, then the resistance to material removal is proportional not only to hardness, but to fracture toughness as well. Brittle materials typically exhibit a trade-off between hardness and fracture toughness. Some materials, notably ceramics, show a decrease in abrasive wear resistance with increasing bulk hardness. This decrease in wear resistance is accompanied by a decrease in fracture toughness. Fundamental studies of abrasive wear in brittle materials indicate that they undergo radial and lateral cracking from stresses induced by point-contact loads created by abrasive particles. This implies that material removal in this situation is by a sub-surface crack-joining mechanism, and suggests that brittle fracture is the primary route of material removal.

Therefore, in order to maximize the abrasive wear resistance of materials that fail by brittle fracture, it is necessary to obtain a preferred combination of hardness and fracture toughness.

Since the QC phase is harder than the FeAl phase, one expects 1 volume percent FeAl sample to be harder than the composite or 100 volume percent FeAl coating. However, the 1 volume percent FeAl coating has a higher average hardness than the pure QC coatings. The improved abrasive wear resistance produced by adding a very small fraction of a ductile phase to a brittle matrix is the combined result of increased average coating hardness and increased effective coating fracture toughness. The latter is evidenced by the clear transition from a brittle fracture wear mode to wear via plastic flow.

The wear behavior of a brittle matrix can be radically changed through the addition of only 1 volume percent of a ductile phase, particularly since the FeAl phase is added as discrete particles. Since the starting powder particle sizes were the same for both materials, the fact that the FeAl splats are thinner than the QC splats in the cross-section implies that the FeAl splats must occupy a relatively larger area within the plane of the coating (i.e., parallel to the substrate).

Plasma arc sprayed Al—Cu—Fe quasicrystalline coatings are very brittle and exhibit poor abrasive wear resistance. The addition of a relatively ductile FeAl phase improved the abrasion resistance by increasing the effective fracture toughness of the composite coating. This is observed as a transition in the abrasive wear mode from brittle fracture to plastic flow. Composite coatings with the highest level of FeAl additions do not necessarily lead to the least material removal during wear testing. Rather, the addition of only 1 volume percent of the FeAl phase to the quasicrystalline matrix leads to a plastic flow wear mode and, in addition, produces a coating having the highest average hardness and the best abrasion resistance.

Other alternate brittle matrices that could be used include oxide ceramics, nitride ceramics, carbide ceramics or intermetallics. Other alternate ductile reinforcements may include other aluminides or elemental reinforcements such as Ni, Cu or Al.

It is therefore seen that this invention will achieve at least its stated objectives.

We claim:

1. An abrasion resistant coating for deposition onto a substrate, comprising, a quasicrystalline brittle matrix incorporated with a ductile phase.

2. The abrasion resistant coating of claim 1 wherein said ductile phase is a FeAl intermetallic.

3. The abrasion resistant coating of claim 1 wherein the brittle matrix is comprised of Al—Cu—Fe quasicrystalline material.

4. The abrasion resistant coating of claim 1 wherein said ductile phase is a FeAl intermetallic and wherein the brittle matrix is comprised of Al—Cu—Fe quasicrystalline material.

5. The abrasion resistant coating of claim 1 wherein said quasicrystalline brittle matrix and ductile phase are combined by plasma spraying.

6. The abrasion resistant coating of claim 2 wherein the FeAl is present at a level of approximately 1 volume percent.

7. The abrasion resistant coating of claim 2 wherein the FeAl is present at a level of approximately 5–50 volume percent.

8. The abrasion resistant coating of claim 2 wherein the FeAl is present at a level of approximately 1–20 volume percent.

9. A method of making an abrasion resistant coating for a substrate material, comprising, taking a quasicrystalline brittle matrix, and incorporating with the brittle matrix a ductile phase to form an abrasion resistant coating, and depositing said abrasion resistant coating on a substrate.

10. The method of claim 9 wherein the ductile phase is a FeAl intermetallic.

11. The method of claim 9 wherein the brittle matrix is comprised of Al—Cu—Fe quasicrystalline material.

12. The method of claim 9 wherein said ductile phase is a FeAl intermetallic and wherein the brittle matrix is comprised of Al—Cu—Fe quasicrystalline material.

13. The method of claim 9 wherein said brittle matrix and ductile phase are combined by plasma spraying.

14. The method of claim 10 wherein the FeAl is present at a level of approximately 1 volume percent.

15. The method of claim 10 wherein the FeAl is present at a level of approximately 5–50 volume percent.

16. The method of claim 10 wherein the FeAl is present at a level of approximately 1–20 volume percent.

17. The method of claim 9 wherein a sufficient ductile phase is added to the brittle matrix to transform the abrasive wear mode of the matrix from brittle fracture to plastic deformation without reducing the hardness of the composite matrix and ductile metallic layer phase below that of the original matrix.

18. The abrasion resistant coating of claim 1 wherein the brittle matrix is comprised of one or more of oxide ceramics, nitride ceramics, carbide ceramics or intermetallics.

19. The abrasion resistant coating of claim 1 wherein the ductile phase comprises aluminides.

20. The abrasion resistant coating of claim 1 wherein the ductile phase comprises elemental reinforcements selected from the group consisting of Ni, Cu or Al.

* * * * *